US007389787B2

(12) United States Patent
Means et al.

(10) Patent No.: US 7,389,787 B2
(45) **Date of Patent: *Jun. 24, 2008**

(54) CLOSED LOOP ADDITIVE INJECTION AND MONITORING SYSTEM FOR OILFIELD OPERATIONS

(75) Inventors: C. Mitch Means, Needville, TX (US); David H. Green, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 517 days.

This patent is subject to a terminal disclaimer.

(21) Appl. No.: 11/052,429

(22) Filed: Feb. 7, 2005

(65) Prior Publication Data

US 2005/0166961 A1 Aug. 4, 2005

Related U.S. Application Data

(63) Continuation-in-part of application No. 09/658,907, filed on Sep. 11, 2000, now Pat. No. 6,851,444, which is a continuation-in-part of application No. 09/218,067, filed on Dec. 21, 1998, now abandoned.

(60) Provisional application No. 60/153,175, filed on Sep. 10, 1999.

(51) Int. Cl.
*G05D 7/06* (2006.01)

(52) U.S. Cl. ..... 137/13; 137/486; 137/487.5; 166/250.01

(58) Field of Classification Search ..... 137/13, 137/486, 487.5; 166/250.01, 250.15; 700/29, 700/30, 31

See application file for complete search history.

(56) References Cited

U.S. PATENT DOCUMENTS

| | | | |
|---|---|---|---|
| 3,211,225 | A | 10/1965 | Thiessen et al. |
| 3,710,867 | A | 1/1973 | Bansbach |
| 4,064,936 | A | 12/1977 | McClure |
| 4,160,734 | A | 7/1979 | Taylor et al. |
| 4,284,143 | A | 8/1981 | Scherrer et al. |
| 4,354,553 | A | 10/1982 | Hensley |
| 4,375,833 | A | 3/1983 | Meadows |

(Continued)

FOREIGN PATENT DOCUMENTS

| | | |
|---|---|---|
| WO | WO98/50680 | 12/1998 |

(Continued)

*Primary Examiner*—Ramesh Krishnamurthy
(74) *Attorney, Agent, or Firm*—Madan, Mossman & Sriram, P.C.

(57) ABSTRACT

A system is provided that monitors at the wellsite injection of additives into formation fluids recovered through wellbores and controls the supply of such additives from remote locations. The selected additive is supplied from a source at the wellsite into the wellbore via a suitable supply line. A flow meter in the supply line measures the flow rate of the additive through the supply line and generates signals representative of the flow rate. A controller at the wellsite determines the flow rate from the flow meter signals and in response thereto controls the flow rate of the additive to the well. The wellsite controller interfaces with a suitable two-way communication link and transmits signals and data representative of the flow rate and other parameters to a second remote controller. The remote controller transmits command signals to the wellsite controller representative of any change desired for the flow rate.

25 Claims, 5 Drawing Sheets

U.S. PATENT DOCUMENTS 4,436,148 A 3/1984 Maxwell
4,566,536 A 1/1986 Holmes
4,580,952 A 4/1986 Eberle
4,582,131 A 4/1986 Plummer et al.
4,635,723 A 1/1987 Spivey
4,665,981 A 5/1987 Hayatdavoudi
4,721,158 A 1/1988 Merritt, Jr. et al.
4,747,451 A 5/1988 Adams, Jr. et al.
4,830,112 A 5/1989 Erickson
4,832,121 A 5/1989 Anderson
4,843,247 A 6/1989 Yamazoe et al.
4,901,563 A 2/1990 Pearson
4,907,857 A 3/1990 Giuliani et al.
4,974,929 A 12/1990 Curry
5,059,790 A 10/1991 Klainer et al.
5,098,659 A 3/1992 Yim et al.
5,115,811 A 5/1992 Hartlaub et al.
5,147,561 A 9/1992 Burge et al.
5,172,717 A 12/1992 Boyle et al.
5,209,301 A 5/1993 Ayres
5,285,715 A * 2/1994 Elrod et al. ..... 91/361
5,307,146 A 4/1994 Porter et al.
5,335,730 A * 8/1994 Cotham, III ..... 166/374
5,353,237 A 10/1994 Bass et al.
5,359,681 A 10/1994 Jorgenson et al.
5,413,175 A 5/1995 Edmunds
5,418,614 A 5/1995 Brost et al.
5,517,593 A 5/1996 Nenniger et al.
5,569,838 A 10/1996 Broedel et al.
5,570,437 A 10/1996 Kluth et al.
5,590,958 A 1/1997 Dearing, Sr. et al.
5,672,515 A 9/1997 Furlongal
5,706,896 A 1/1998 Tubel et al.
5,714,121 A 2/1998 Alderete et al.
5,735,346 A 4/1998 Brewer
5,747,348 A 5/1998 Jaduszliwer et al.
5,829,520 A 11/1998 Johnson
5,872,876 A 2/1999 Kluth et al.
5,937,946 A 8/1999 Streetman
5,992,230 A 11/1999 Scarpa et al.
5,992,250 A 11/1999 Kluth et al.
6,006,828 A 12/1999 Kluth et al.
6,006,832 A 12/1999 Tubel et al.
6,022,748 A 2/2000 Charych et al.
6,026,847 A 2/2000 Reinicke et al.
6,125,938 A 10/2000 Garcia-Soule et al.
6,257,332 B1 * 7/2001 Vidrine et al. ..... 166/250.15
6,851,444 B1 * 2/2005 Kohl et al. ..... 137/13
2005/0150552 A1 * 7/2005 Forshey ..... 137/486

FOREIGN PATENT DOCUMENTS

WO WO98/57030 12/1998

* cited by examiner

CLOSED LOOP ADDITIVE INJECTION AND MONITORING SYSTEM FOR OILFIELD OPERATIONS

RELATED APPLICATIONS

This application is a continuation-in-part of U.S. patent application Ser. No. 09/658,907 filed on Sep. 11, 2000; now issued as U.S. Pat. No. 6,851,444; which is a continuation-in-part of U.S. Provisional Patent Application Ser. No. 60/153,175 filed on Sep. 10, 1999 and U.S. patent application Ser. No. 09/218,067 filed on Dec. 21, 1998 now abandoned.

BACKGROUND OF THE INVENTION

1. Field of the Invention

This invention relates generally to oilfield operations and more particularly to a remotely/network-controlled additive injection system for injecting precise amounts of additives or chemicals into wellbores, wellsite hydrocarbon processing units, pipelines, and chemical processing units.

2. Background of the Art

A variety of chemicals (also referred to herein as "additives") are often introduced into producing wells, wellsite hydrocarbon processing units, oil and gas pipelines and chemical processing units to control, among other things, corrosion, scale, paraffin, emulsion, hydrates, hydrogen sulfide, asphaltenes and formation of other harmful chemicals. In oilfield production wells, additives are usually injected through a tubing (also referred to herein as "conductor line") that is run from the surface to a known depth. Additives are introduced in connection with electrical submersible pumps (as shown for example in U.S. Pat. No. 4,582,131 which is assigned to the assignee hereof and incorporated herein by reference) or through an auxiliary tubing associated with a power cable used with the electrical submersible pump (such as shown in U.S. Pat. No. 5,528,824 (assigned to the assignee hereof and incorporated herein by reference). Injection of additives into fluid treatment apparatus at the well site and pipelines carrying produced hydrocarbons is also known.

For oil well applications, a high pressure pump is typically used to inject an additive into the well from a source thereof at the wellsite. The pump is usually set to operate continuously at a set speed or stroke length to control the amount of the injected additive. A separate pump and an injector are typically used for each type of additive. Manifolds are sometimes used to inject additives into multiple wells; production wells are sometimes unmanned and are often located in remote areas or on substantially unmanned offshore platforms. A recent survey by Baker Hughes Incorporated of certain wellbores revealed that as many as thirty percent (30%) of the additive pumping systems at unmanned locations were either injecting incorrect amounts of the additives or were totally inoperative. Insufficient amounts of treatment additives can increase the formation of corrosion, scale, paraffins, emulsion, hydrates etc., thereby reducing hydrocarbon production, the operating life of the wellbore equipment and the life of the wellbore itself, requiring expensive rework operations or even the abandonment of the wellbore. Excessive corrosion in a pipeline, especially a subsea pipeline, can rupture the pipeline, contaminating the environment. Repairing subsea pipelines can be cost-prohibitive.

Commercially-used wellsite additive injection apparatus usually require periodic manual inspection to determine whether the additives are being dispensed correctly. It is important and economically beneficial to have additive injection systems which can supply precise amounts of additives and which systems are adapted to periodically or continuously monitor the actual amount of the additives being dispensed, determine the impact of the dispersed additives, vary the amount of dispersed additives as needed to maintain certain desired parameters of interest within their respective desired ranges or at their desired values, communicate necessary information with offsite locations and take actions based in response to commands received from such offsite locations. The system should also include self-adjustment within defined parameters. Such a system should also be developed for monitoring and controlling additive injection into multiple wells in an oilfield or into multiple wells at a wellsite, such as an offshore production platform. Manual intervention at the wellsite of the system to set the system parameters and to address other operational requirements should also be available.

The present invention addresses the above-noted problems and provides an additive injection system which dispenses precise amounts of additives, monitors the dispensed amounts, communicates with remote locations, takes corrective actions locally, and/or in response to commands received from the remote locations.

SUMMARY OF THE INVENTION

In one aspect, the present invention is a system for monitoring and controlling a supply of an additive introduced into formation fluid within a production wellbore, comprising: (a) a flow control device for supplying a selected additive from a source thereof at a wellsite to the formation fluid being recovered from the production wellbore; (b) a flow measuring device for providing a signal representative of the flow rate of the selected additive supplied to said formation fluid in the production wellbore; (c) a first onsite controller receiving the signals from the flow measuring device and determining therefrom the flow rate, said first onsite controller transmitting signals representative of the flow rate to a remote location; and (d) a second remote controller at said remote location receiving signals transmitted by said first controller and in response thereto transmitting command signals to said first controller representative of a desired change in the flow rate of the selected additive; wherein the first onsite controller causes the flow control device to change the flow rate of the selected additive in response to the command signals and the system supplies the selected additive such that it is present at a concentration of from about 1 ppm to about 10,000 ppm in the formation fluid recovered from the production wellbore, and the first onsite controller is programmed with a step based flow rate control model.

A method of monitoring at a wellsite, the supply of additives to formation fluid recovered through a production wellbore and controlling said supply of additives into the production wellbore from a remote location, said method comprising: (a) controlling the flow rate of the supply of a selected additive from a source thereof at the wellsite into said formation fluid via a supply line into the production wellbore using the above described system; (b) measuring a parameter indicative of the flow rate of the additive supplied to said formation fluid and generating a signal indicative of said flow rate; (c) receiving at the wellsite the signal indicative of the flow rate and transmitting a signal representative of the flow rate to the remote location; and (d)receiving at said remote location signals transmitted from the wellsite and in response thereto transmitting command signals to the wellsite representative of a desired change in the flow rate of the additive supplied; and (e) controlling the flow rate of the supply of the additive in response to the command signals such that the additive is present at a concentration of from about 1 ppm to about 10,000 ppm in the formation fluid recovered from the wellbore.

BRIEF DESCRIPTION OF THE DRAWINGS

For a detailed understanding of the present invention, reference should be made to the following detailed description of the preferred embodiments, taken in conjunction with the accompanying drawings, in which like elements have been given like numerals, wherein.

DETAILED DESCRIPTION OF PREFERRED EMBODIMENTS

Figure 1:
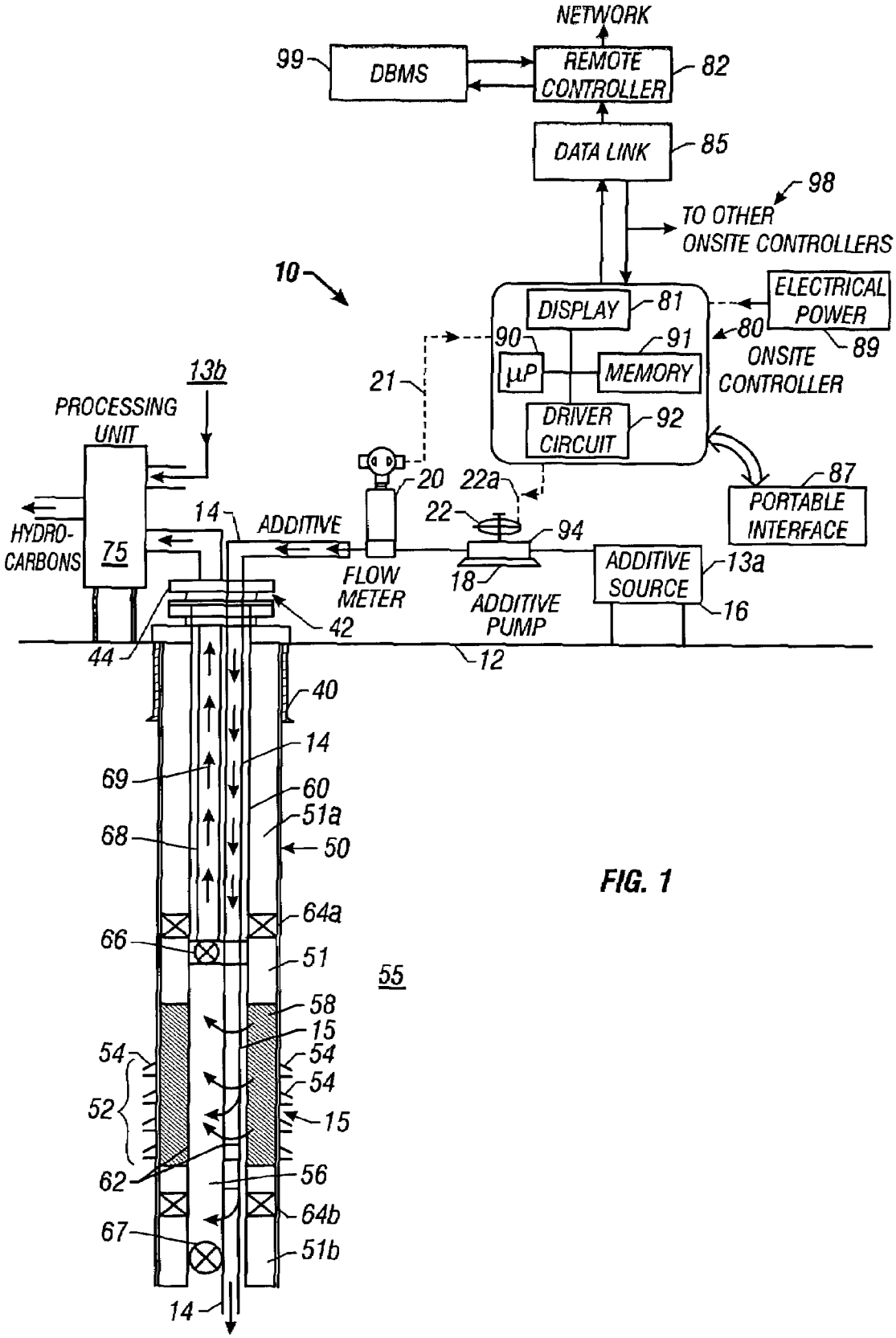
FIG. 1 is a schematic illustration of a additive injection and monitoring system according to one embodiment of the present invention.

In one embodiment the present invention provides a wellsite additive injection system that injects, monitors and controls the supply of additives into fluids recovered through wellbores, including with input from remote locations as appropriate. The system includes a pump that supplies, under pressure, a selected additive from a source thereof at the wellsite into the wellbore via a suitable supply line. A flow meter in the supply line measures the flow rate of the additive and generates signals representative of the flow rate. A controller at the wellsite (wellsite or onsite controller) determines from the flow meter signals the additive flow rate, presents that rate on a display and controls the operation of the pump according to stored parameters in the controller and in response to command signals received from a remote location. The controller interfaces with a suitable two-way communication link and transmits signals and data representative of the flow rate and other relevant information to a second controller at a remote location preferably via an EIA-232 or EIA-485 communication interface. The remote controller may be a computer and may be used to transmit command signals to the wellsite controller representative of any change desired for the flow rate. The wellsite controller adjusts the flow rate of the additive to the wellbore to achieve the desired level of chemical additives.

The wellsite controller is preferably a microprocessor-based system and can be programmed to adjust the flow rate automatically when the calculated flow rate is outside predetermined limits provided to the controller. The flow rate is increased when it falls below a lower limit and is decreased when it exceeds an upper limit. Also an embodiment of the present invention is a system wherein the controller can also switch between redundant pumps when the flow rate cannot be controlled with the pump then in-service.

In an alternative embodiment of the present invention, additives are supplied to a wellbore using a high pressure pad upon the additives, or some other form of pressure driven injection rather than electrical or pneumatic pumps. This embodiment is particularly desirable in applications where only a small volume of additives are to be injected. While a pressure source, such as a compressed nitrogen or air cylinder has a finite volume, that volume can be large in comparison to the volume to be injected. The disadvantage of requiring replenishment may, in some applications, be offset in costs such as the capital cost of pumps or the costs of supplying electricity.

The control valve, in some embodiments of the invention, will be a high pressure control valve or even a two stage high pressure control valve. In a two stage high pressure control valve, the pressure of the additives being fed are reduce not once but twice allowing for more accurate control of the flow through the valve.

The system of the present invention may be configured for multiple wells at a wellsite, such as an offshore platform. In one embodiment, such a system includes a separate pump, a fluid line and an onsite controller for each well. Alternatively, a suitable common onsite controller may be provided to communicate with and to control multiple wellsite pumps via addressable signaling. A separate flow meter for each pump provides signals representative of the flow rate for its associated pump to the onsite common controller. The onsite controller may be programmed to display the flow rates in any order as well as other relevant information. The onsite controller at least periodically polls each flow meter and performs the above-described functions. The common onsite controller transmits the flow rates and other relevant or desired information for each pump to a remote controller. The common onsite controller controls the operation of each pump in accordance with the stored parameters for each such pump and in response to instructions received from the remote controller. If a common additive is used for a number of wells, a single additive source may be used. A single or common pump may also be used with a separate control valve in each supply line that is controlled by the controller to adjust their respective flow rates.

A suitable precision low-flow, flow meter is utilized to make precise measurements of the flow rate of the injected additive. Any positive displacement-type flow meter, including a rotating flow meter, may also be used. The onsite controller is environmentally sealed and can operate over a wide temperature range. The present system is adapted to port to a variety of software and communications protocols and may be retrofitted on the commonly used manual systems, existing process control systems, or through uniquely developed additive management systems developed independently or concurrently.

The additive injection of the present invention may also utilize a mixer wherein different additives are mixed or combined at the wellsite and the combined mixture is injected by a common pump and metered by a common meter. The onsite controller controls the amounts of the various additives into the mixer. The additive injection system may further include a plurality of sensors downhole which provide signals representative of one or more parameters of interest relating to the characteristics of the produced fluid, such as the presence or formation of sulfites, hydrogen sulfide, paraffin, emulsion, scale, asphaltenes, hydrates, fluid flow rates from various perforated zones, flow rates through downhole valves, downhole pressures and any other desired parameter. The system may also include sensors or testers at the surface which provide information about the characteristics of the produced fluid. The measurements relating to these various parameters are provided to the wellsite controller which interacts with one or more models or programs provided to the controller or determines the amount of the various additives to be injected into the wellbore and/or into the surface fluid treatment unit and then causes the system to inject the correct amounts of such additives. In one aspect, the system continuously or periodically updates the models based on the various operating conditions and then controls the additive injection in response to the updated models. This provides a closed-loop system wherein static or dynamic models may be utilized to monitor and control the additive injection process.

In one embodiment of the present invention, the controller receives at least two signals representative of one or more parameters of interest. In one such embodiment, the signal is for the same parameter of interest but taken in more than one location. In another such embodiment, the signals are for different parameters of interest, such as sulfites and scale. In either embodiment, the model for controlling the rate of flow of additives may be more complex than a model driven by a single such signal.

One embodiment of the invention wherein a complex model may be required is one such as that described immediately above wherein two parameters of interest are used for controlling the flow of additives. It may be that a single additive will be used in conjunction with both parameters, but the system of the present invention could also be used to control two separate additives in two separate streams into the borehole in response to the sensor signals. Such a system is within the scope of the present invention.

The system of the present invention is equally applicable to monitoring and control of additive injection into oil and gas pipelines (e.g. drag reducer additive), wellsite fluid treatment units, and refining and petrochemical chemical treatment applications.

The additives injected using the present inventions are injected in very small amounts. Preferably, the flow rate for an additive injected using the present invention is at a rate such that the additive is present at a concentration of from about 1 parts per million (ppm) to about 10,000 ppm in the fluid being treated. More preferably, the flow rate for an additive injected using the present invention is at a rate such that the additive is present at a concentration of from about 1 ppm to about 500 ppm in the fluid being treated. Most preferably the flow rate for an additive injected using the present invention is at a rate such that the additive is present at a concentration of from about 10 ppm to about 400 ppm in the fluid being treated.

Since the additives injected using the present invention can be injected a very low rates, it is possible that a system of the present invention could be powered either totally or at least in part using solar power, fuel cell technology, or other alternative methods of powering a remote device known to be useful to those of ordinary skill in the art of preparing additive injection systems. The advantages of such a system, especially in a remote location are many but include at least reduced infrastructure costs and/or capital costs. In one such embodiment, the system includes a compressed air supply for driving the additives, control valves and other moving parts. Solar power is then used to provide electricity to the electronics. In a preferred embodiment, batteries or another device useful for accumulating electromotive force (emf) for later use are used to drive the system during periods of darkness. In one preferred embodiment, solar power generated emf is used to drive and power all parts of the injection system.

Another aspect of the present invention relates to the fact that often small amounts of additives are injected using the present invention. In one embodiment, the controller of the present invention is programmed with a step based flow rate control model. In a conventional Proportion Integral and Derivative (PID) controller, the controller responds very quickly to changes in the flow passing through the device measuring flow. This can be a problem with the present invention where often the additives are driven by a pump in pulses rather than a constant flow. For example, if the flow rates are very low, it is possible that a conventional PID controller will make one or more measurements and corresponding adjustments to the flow control device between pulses of the pump resulting in over-correction.

To avoid such a problem, one embodiment of the present invention employs a controller that is first programmed with process variables such as flow rates, analyzer values and desired ppm of the chemical. The controller then calculates the amount of chemical needed and determines a set point in units of volume per day. With this set point and based on the programmed maximum capacity of the chemical pump, the unit estimates where to set the pump output. Once the output is set, the controller may, for example, average the incoming chemical pulses from the flow meter and determine whether or not the set point is being reached. If the set point is not being reached or if the set point is exceeded, the controller raises or lowers the pump output by, for example, 1 percentage point and again determines the variation from the set point. It continues as above until the set point is reached. In some embodiments, if the set point changes by more than, for example, 5 percent, the controller will recalculate the pump output and "jump" to that value. The exemplary values above can be changed as required based upon the specific application. In a different embodiment, the values above could range from 0.5 to 20 percent FIG. 1 is a schematic diagram of a wellsite additive injection system 10 according to one embodiment of the present invention. The system 10, in one aspect, is shown as injecting and monitoring of additives 13*a* into a wellbore 50 and, in another aspect, injecting and monitoring of additives 13*b* into a wellsite surface treatment or processing unit 75. The wellbore 50 is shown to be a production well using typical completion equipment. The wellbore 50 has a production zone 52 which includes multiple perforations 54 through the formation 55. Formation fluid 56 enters a production tubing 60 in the well 50 via perforations 54 and passages 62. A screen 58 in the annulus 51 between the production tubing 60 and the formation 55 prevents the flow of solids into the production tubing 60 and also reduces the velocity of the formation fluid entering into the production tubing 60 to acceptable levels. An upper packer 64*a* above the perforations 54 and a lower packer 64*b* in the annulus 51 respectively isolate the production zone 52 from the annulus 51*a* above and annulus 51*b* below the production zone 52. A flow control valve 66 in the production tubing 60 can be used to control the fluid flow to the surface 12. A flow control valve 67 may be placed in the production tubing 62 below the perforations 54 to control fluid flow from any production zone below the production zone 52.

A smaller diameter tubing, such as tubing 68, may be used to carry the fluid from the production zones to the surface. A production well usually includes a casing 40 near the surface and wellhead equipment 42 over the wellbore. The wellhead equipment generally includes a blow-out preventor stack 44 and passages for supplying fluids into the wellbore 50. Valves (not shown) are provided to control fluid flow to the surface 12. Wellhead equipment 42 and production well equipment, such as shown in the production well 60, are well known and thus are not described in greater detail.

Referring back to FIG. 1, in one aspect of the present invention, the desired additive 13*a* from a source 16 thereof is injected into the wellbore 50 via an injection line 14 by a suitable pump, such as a positive displacement pump 18 ("additive pump"). The additive 13*a* flows through the line 14 and discharges into the production tubing 60 near the production zone 52 via inlets or passages 15. The same or different injection lines may be used to supply additives to different production zones. In FIG. 1, line 14 is shown extending to a production zone below the zone 52. Separate injection lines allow injection of different additives at different well depths. The same also holds for injection of additives in pipelines or surface processing facilities.

A suitable high-precision, low-flow, flow meter 20 (such as gear-type meter or a nutating meter), measures the flow rate through line 14 and provides signals representative of the flow rate. The pump 18 is operated by a suitable device 22 such as a motor. The stroke of the pump 18 defines fluid volume output per stroke. The pump stroke and/or the pump speed are controlled, e.g., by a 4-20 milliamperes control signal to control the output of the pump 18. The control of air supply controls a pneumatic pump.

In the present invention, an onsite controller 80 controls the operation of the pump 18, either utilizing programs stored in a memory 91 associated with the wellsite controller 80 and/or instructions provided to the wellsite controller 80 from a remote controller or processor 82. The wellsite controller 80 preferably includes a microprocessor 90, resident memory 91 which may include read only memories (ROM) for storing programs, tables and models, and random access memories (RAM) for storing data. The microprocessor 90, utilizing signals from the flow meter 20 received via line 21 and programs stored in the memory 91 determining the flow rate of the additive and displays such flow rate on the display 81. The wellsite controller 80 can be programmed to alter the pump speed, pump stroke or air supply to deliver the desired amount of the additive 13*a*. The pump speed or stroke, as the case may be, is increased if the measured amount of the additive injected is less than the desired amount and decreased if the injected amount is greater than the desired amount. The onsite controller 80 also includes circuits and programs, generally designated by numeral 92 to provide interface with the onsite display 81 and to perform other functions.

The onsite controller 80 polls, at least periodically, the flow meter 20 and determines therefrom the additive injection flow rate and generates data/signals which are transmitted to a remote controller 82 via a data link 85. Any suitable two-way data link 85 may be utilized. There also may be a data management system associated with the remote controller. Such data links may include, among others, telephone modems, radio frequency transmission, microwave transmission and satellites utilizing either EIA-232 or EIA-485 communications protocols (this allows the use of commercially available off-the-shelf equipment). The remote controller 82 is preferably a computer-based system and can transmit command signals to the controller 80 via the link 85. The remote controller 82 is provided with models/programs and can be operated manually and/or automatically to determine the desired amount of the additive to be injected. If the desired amount differs from the measured amount, it sends corresponding command signals to the wellsite controller 80. The wellsite controller 80 receives the command signals and adjusts the flow rate of the additive 13*a* into the well 50 accordingly. The remote controller 82 can also receive signals or information from other sources and utilize that information for additive pump control.

The onsite controller 80 preferably includes protocols so that the flow meter 20, pump control device 22, and data links 85 made by different manufacturers can be utilized in the system 10. In the oil industry, the analog output for pump control is typically configured for 0-5 VDC or 4-20 milliampere (mA) signal. In one mode, the wellsite controller 80 can be programmed to operate for such output. This allows for the system 10 to be used with existing pump controllers. A suitable source of electrical power source 89, e.g., a solar-powered DC or AC power unit, or an onsite generator provides power to the controller 80, converter 83 and other electrical circuit elements. The wellsite controller 80 is also provided with a display 81 that displays the flow rates of the individual flow meters. The display 81 may be scrolled by an operator to view any of the flow meter readings or other relevant information. The display 81 is controllable either by a signal from the remote controller 82 or by a suitable portable interface device 87 at the well site, such as an infrared device or a key pad. This allows the operator at the wellsite to view the displayed data in the controller 80 non-intrusively without removing the protective casing of the controller.

Still referring to FIG. 1, the produced fluid 69 received at the surface is processed by a treatment unit or processing unit 75. The surface processing unit 75 may be of the type that processes the fluid 69 to remove solids and certain other materials such as hydrogen sulfide, or that processes the fluid 69 to produce semi-refined to refined products. In such systems, it is desired to periodically or continuously inject certain additives. A system, such as system 10 shown in FIG. 1 can be used for injecting and monitoring additives into the treatment unit 75.

In addition to the flow rate signals 21 from the flow meter 20, the wellsite controller 80 may be configured to receive signals representative of other parameters, such as the rpm of the pump 18, or the motor 22 or the modulating frequency of a solenoid valve. In one mode of operation, the wellsite controller 80 periodically polls the meter 20 and automatically adjusts the pump controller 22 via an analog input 22*a* or alternatively via a digital signal of a solenoid controlled system (pneumatic pumps). The controller 80 also can be programmed to determine whether the pump output, as measured by the meter 20, corresponds to the level of signal 22*a*. This information can be used to determine the pump efficiency. It can also be an indication of a leak or another abnormality relating to the pump 18. Other sensors 94, such as vibration sensors, temperature sensors may be used to determine the physical condition of the pump 18. Sensors which determine properties of the wellbore fluid can provide information of the treatment effectiveness of the additive being injected, which information can then be used to adjust the additive flow rate as more fully described below in reference to FIG. 3. The remote controller 82 may control multiple onsite controllers via a link 98. A data base management system 99 may be provided for the remote controller 82 for historical monitoring and management of data. The system 10 may further be adapted to communicate with other locations via a network (such as the Internet) so that the operators can log into the database 99 and monitor and control additive injection of any well associated with the system 10.

Figure 1A:
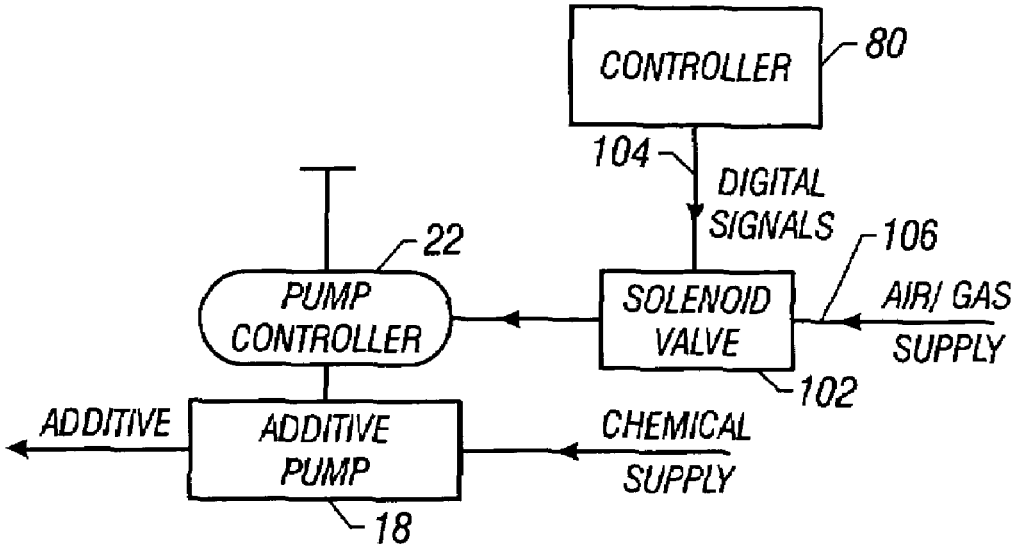
FIG. 1A shows an alternative manner for controlling the operation of the chemical additive pump.

FIG. 1A shows an alternative manner for controlling the additive pump. This configuration includes a control valve, such as a solenoid valve 102, in the supply line 106 from a source of fluid under pressure (not shown) for the pump controller 22. The controller 80 controls the operation of the valve via suitable control signals, such as digital signals, provided to the valve 102 via line 104. The control of the valve 22 controls the speed or stroke of the pump 18 and thus the amount of the additive supplied to the wellbore 50. The valve control 102 may be modulated to control the output of the pump 18.

Figure 1B:
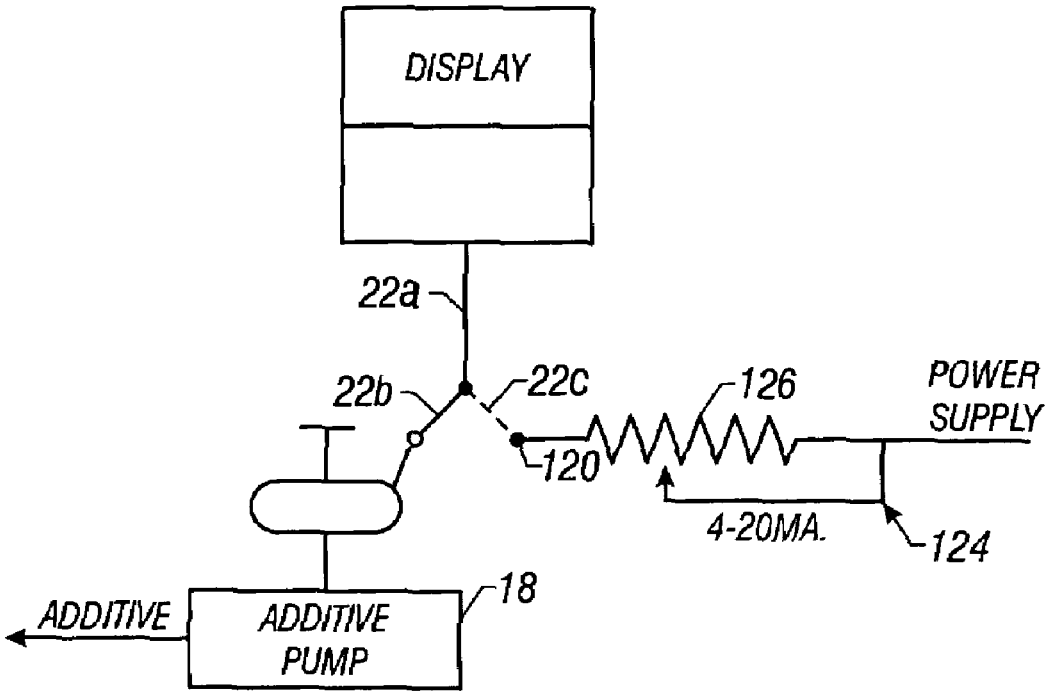
FIG. 1B shows a circuit for providing a measure of manual control of the controller for additive injection pump 22.

The automated modes of operation (both local and/or from the remote location) of the injection system 10 are described above. However, in some cases it is desirable to operate the control system 10 in a manual mode, such as by an operator at the wellsite. Manual control may be required to override the system because of malfunction of the system or to repair parts of the system 10. FIG. 1B shows a circuit 124 for manual control of the additive pump 18. The circuit 124 includes a switch 120 associated with the controller (see FIG. 1), which in a first or normal position (solid line 22*b*) allows the analog signal 22*a* from the controller to control the motor 22 and in the second position (dotted line 22*c*) allows the manual circuit 124 to control the motor 22. The circuit 124, in one configuration, may include a current control circuit, such as a rheostat 126 that enables the operator to set the current at the desired value. In the preferred embodiment, the current range is set between 4 and 20 milliamperes, which is compatible with the current industry protocol. The wellsite controller is designed to interface with manually-operated portable remote devices, such as infrared devices. This allows the operator to communicate with and control the operation of the system 10 at the well site, e.g., to calibrate the system, without disassembling the wellsite controller 80 unit. This operator may reset the allowable ranges for the flow rates and/or setting a value for the flow rate.

Figure 2:
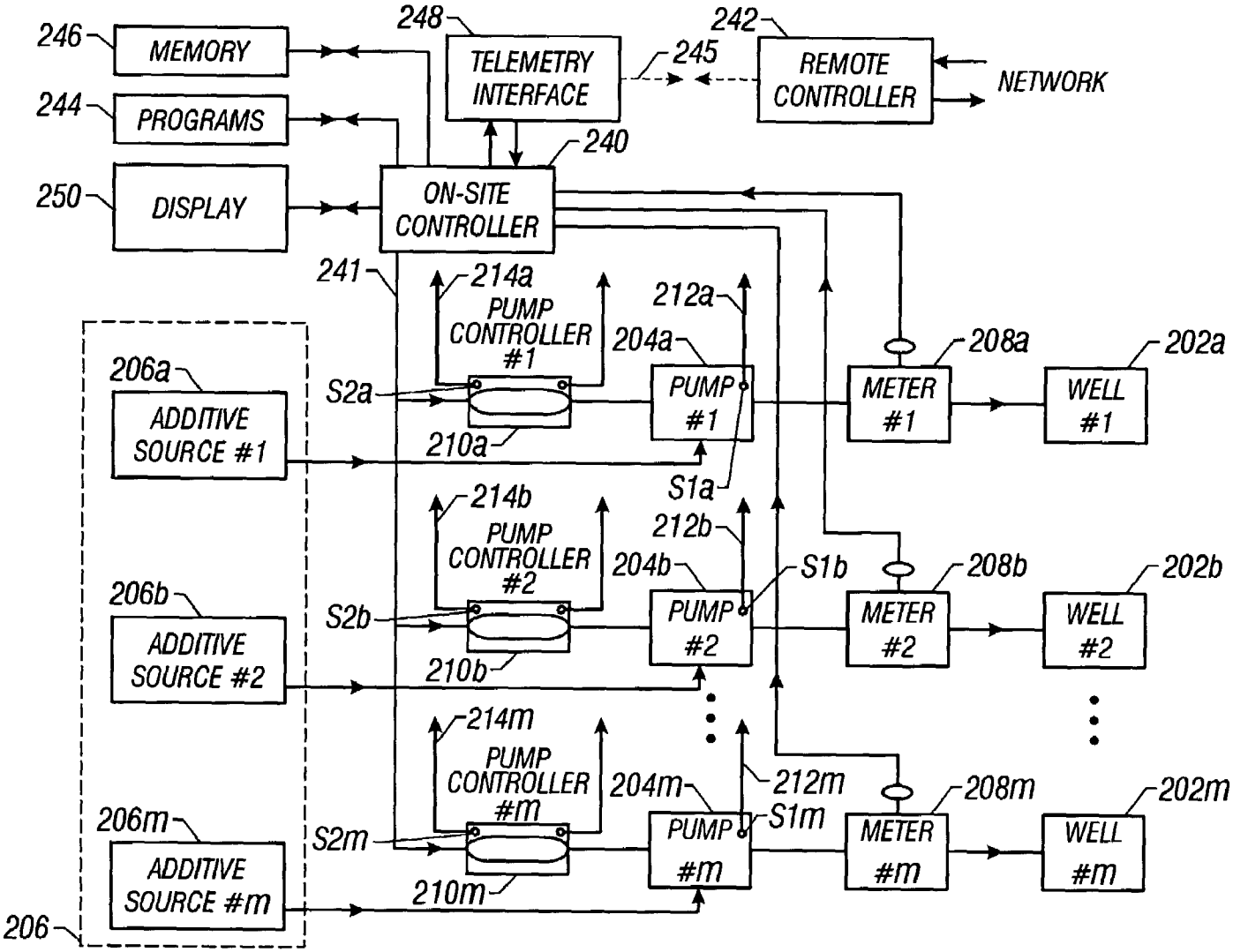
FIG. 2 shows a functional diagram depicting one embodiment of the system for controlling and monitoring the injection of additives into multiple wellbores, utilizing a central controller on an addressable control bus.

As noted above, it is common to drill several wellbores from the same location. For example, it is common to drill 10-20 wellbores from a single offshore platform. After the wells are completed and producing, a separate pump and meter are installed to inject additives into each such wellbore. FIG. 2 shows a functional diagram depicting a system 200 for controlling and monitoring the injection of additives into multiple wellbores 202*a*-202*m* according to one embodiment of the present invention. In the system configuration of FIG. 2, a separate pump supplies an additive from a separate source to each of the wellbores 202*a*-202*m*. Pump 204*a* supplies an additive from the source 206*a*. Meter 208*a* measures the flow rate of the additive into the wellbore 202*a* and provides corresponding signals to a central wellsite controller 240. The wellsite controller 240 in response to the flow meter signals and the programmed instructions or instructions from a remote controller 242 controls the operation of pump control device or pump controller 210*a* via a bus 241 using addressable signaling for the pump controller 210*a*. Alternatively, the wellsite controller 240 may be connected to the pump controllers via a separate line. Furthermore, a plurality of wellsite controllers, one for each pump may be provided, wherein each such controller communicating with the remote controller 242 via a suitable communication link as described above in reference to FIG. 1. The wellsite controller 240 also receives signal from sensor S1*a* associated with pump 204*a* via line 212*a* and from sensor S2*a* associated with the pump controller 210*a* via line 212*a*. Such sensors may include rpm sensor, vibration sensor or any other sensor that provides information about a parameter of interest of such devices. Additives to the wells 202*b*-202*m* are respectively supplied by pumps 204*b*-204*m* from sources 206*b*-206*m*. Pump controllers 210*b*-210*m* respectively control pumps 204*b*-204*m* while flow meters 208*b*-208*m* respectively measure flow rates to the wells 202*b*-202*m*. Lines 212*b*-212*m* and lines 214*b*-214*m* respectively communicate signals from sensor $S_{1b}$-$S_{1m}$ and $S_{2b}$-$S_{2m}$ to the central controller 240. The controller 240 utilizes memory 246 for storing data in memory 244 for storing programs in the manner described above in reference to system 10 of FIG. 1. A suitable two-way communication link 245 allows data and signals communication between the central wellsite controller 240 and the remote controller 242. The individual controllers would communicate with the sensors, pump controllers and remote controller via suitable corresponding connections.

The central wellsite controller 240 controls each pump independently. The controller 240 can be programmed to determine or evaluate the condition of each of the pumps 204*a*-204*m* from the sensor signals $S_{1a}$-$S_{1m}$ and $S_{2a}$-$S_{2m}$. For example the controller 240 can be programmed to determine the vibration and rpm for each pump. This can provide information about the effectiveness of each such pump. The controller 240 can be programmed to poll the flow rates and parameters of interest relating to each pump, perform desired computations at the well site and then transmit the results to the remote controller 242 via the communication link 248. The remote controller 242 may be programmed to determine any course of action from the received information and any other information available to it and transmit corresponding command signals to the wellsite central controller 240. Again, communication with a plurality of individual controllers could be done in a suitable corresponding manner.

Figure 3:
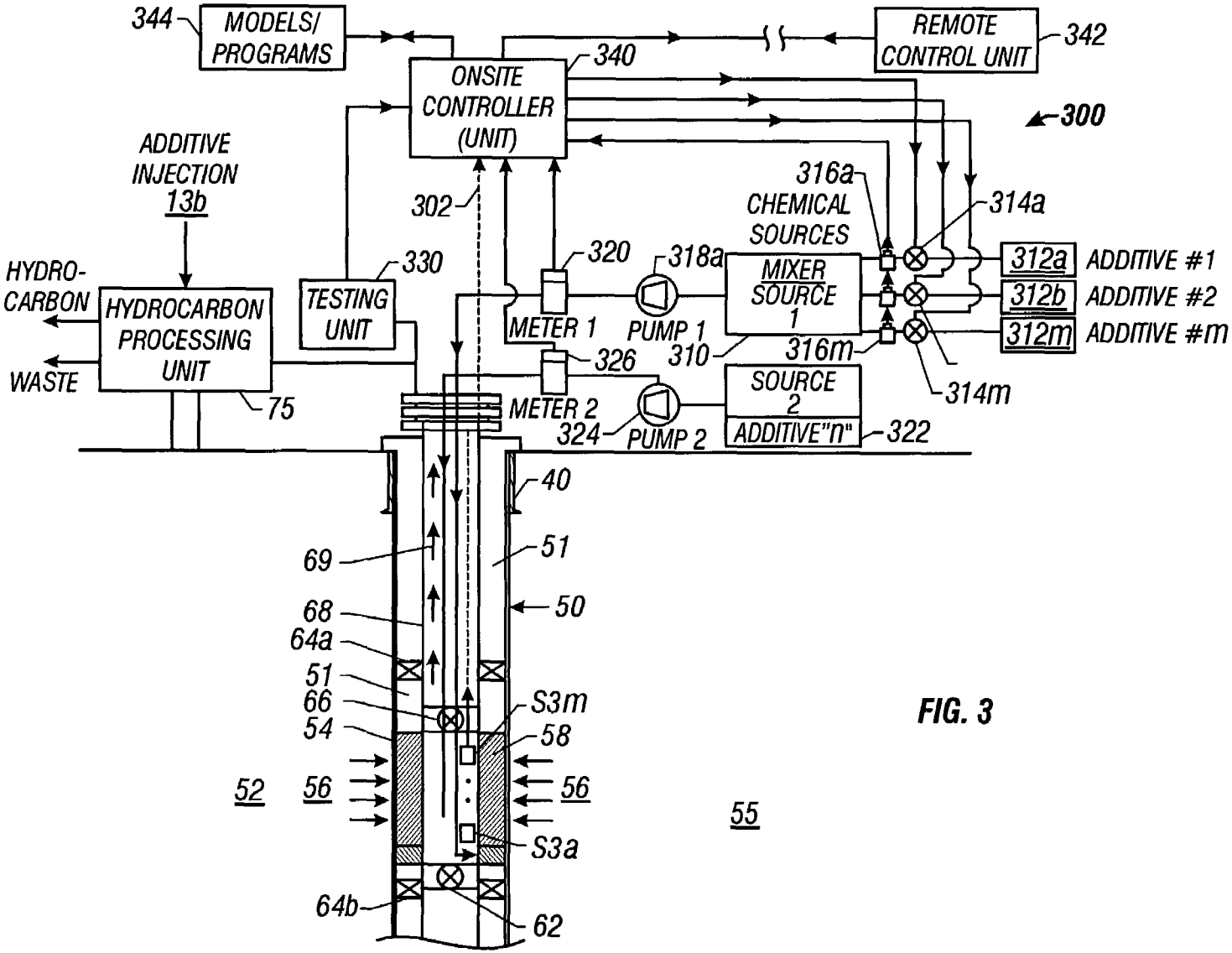
FIG. 3 is a schematic illustration of a wellsite additive injection system which responds to in-situ measurements of downhole and surface parameters of interests according to one embodiment of the present invention.

FIG. 3 is a schematic illustration of wellsite remotely-controllable closed-loop additive injection system 300 which responds to measurements of downhole and surface parameters of interest according to one embodiment of the present invention. Certain elements of the system 300 are common with the system 10 of FIG. 1. For convenience, such common elements have been designated in FIG. 3 with the same numerals as specified in FIG. 1.

The well 50 in FIG. 3 further includes a number of downhole sensors $S_{3a}$-$S_{3m}$ for providing measurements relating to various downhole parameters. Sensor $S_{3a}$ provide a measure of chemical characteristics of the downhole fluid, which may include a measure of the paraffins, hydrates, sulfides, scale, asphaltenes, emulsion, etc. Other sensors and devices $S_{3m}$ may be provided to determine the fluid flow rate through perforations 54 or through one or more devices in the well 50. The signals from the sensors may be partially or fully processed downhole or may be sent uphole via signal/date lines 302 to a wellsite controller 340. In the configuration of FIG. 3, a common central control unit 340 is preferably utilized. The control unit is a microprocessor-based unit and includes necessary memory devices for storing programs and data and devices to communicate information with a remote control unit 342 via suitable communication link 342.

The system 300 may include a mixer 310 for mixing or combining at the wellsite a plurality of additive #1-additive #m stored in sources 313*a*-312*m* respectively. In some situations, it is desirable to transport certain additives in their component forms and mix them at the wellsite for safety and environmental reasons. For example, the final or combined additives may be toxic, although while the component parts may be non-toxic. Additives may be shipped in concentrated form and combined with diluents at the wellsite prior to injection into the well 50. In one embodiment of the present invention, additives to be combined, such as additives additive #1-additive #m are metered into the mixer by associated pumps 314*a*-314*m*. Meters 316*a*-316*m* measure the amounts of the additives from sources 312*a*-312*m* and provide corresponding signals to the control unit 340, which controls the pumps 314*a*-314*m* to accurately dispense the desired amounts into the mixer 310. A pump 318 pumps the combined additives from the mixer 310 into the well 50, while the meter 320 measures the amount of the dispensed additive and provides the measurement signals to the controller 340. A second additive required to be injected into the well 50 may be stored in the source 322, from which source a pump 324 pumps the required amount of the additive into the well. A meter 326 provides the actual amount of the additive dispensed from the source 322 to the controller 340, which in turn controls the pump 324 to dispense the correct amount.

The wellbore fluid reaching the surface may be tested on site with a testing unit 330. The testing unit 330 provides measurements respecting the characteristics of the retrieved fluid to the central controller 340. The central controller utilizing information from the downhole sensors $S_{3a}$-$S_{3m}$, the tester unit data and data from any other surface sensor (as described in reference to FIG. 1) computes the effectiveness of the additives being supplied to the well 50 and determine therefrom the correct amounts of the additives and then alters the amounts, if necessary, of the additives to the required levels.

The controller also provides the computed and/or raw data to the remote control unit 342 and takes corrective actions in response to any command signals received from the remote control unit 342. Thus, the system of the present invention at least periodically monitors the actual amounts of the various additives being dispensed, determines the effectiveness of the dispensed additives, at least with respect to maintaining certain parameters of interest within their respective predetermined ranges, determines the health of the downhole equipment, such as the flow rates and corrosion, determines the amounts of the additives that would improve the effectiveness of the system and then causes the system to dispense additives according to newly computed amounts. The models 344 may be dynamic models in that they are updated based on the sensor inputs.

Thus, the system described in FIG. 3 is a closed-loop, remotely controllable additive injection system. This system may be adapted for use with a hydrocarbon processing unit 75 at the wellsite or for a pipeline carrying oil and gas. The additive injection system of FIG. 3 is particularly useful for subsea pipelines. In oil and gas pipelines, it is particularly important to monitor the incipient formation of hydrates and take prompt corrective actions to prevent them from forming. The system of the present invention can automatically take broad range of actions to assure proper flow of hydrocarbons through pipelines, which not only can avoid the formation of hydrates but also the formation of other harmful elements such as asphaltenes. Since the system 300 is closed loop in nature and responds to the in-situ measurements of the characteristics of the treated fluid and the equipment in the fluid flow path, it can administer the optimum amounts of the various additives to the wellbore or pipeline to maintain the various parameters of interest within their respective limits or ranges, thereby, on the one hand, avoid excessive use of the additives, which can be very expensive and, on the other hand, take prompt corrective action by altering the amounts of the injected additives to avoid formation of harmful elements.

Figure 4:
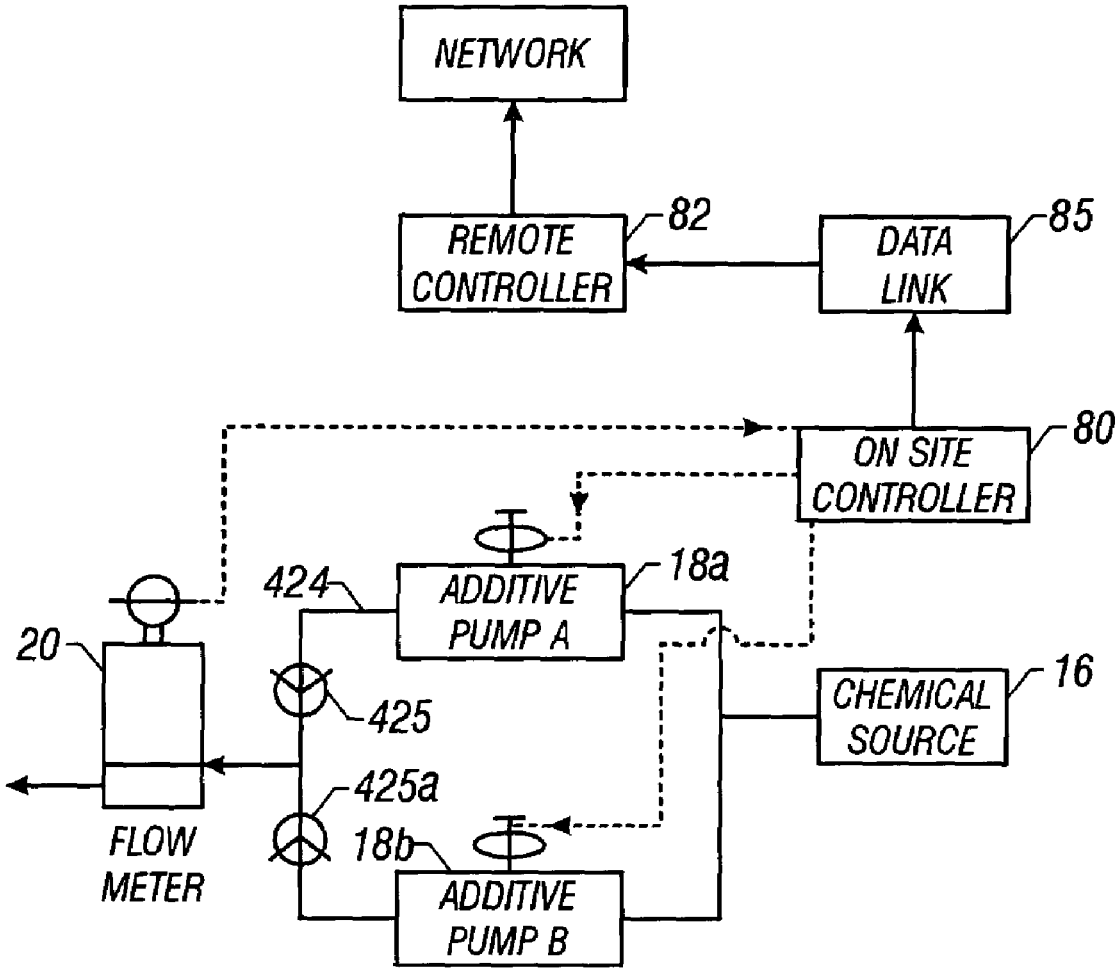
FIG. 4 shows an alternative embodiment of the present invention wherein redundant additive pumps are used to inject additives.

FIG. 4 shows an alternative embodiment of the present invention wherein redundant additive pumps are used to inject additives. Certain elements in FIG. 4 are common with the additive injection and monitoring system of FIG. 1 and those common elements have been designated within FIG. 4 with the same numerals as specified in FIG. 1. In FIG. 4, two additive pumps (18*a* and 18*b*) are piped such that they both can pump additives from a additive source (16) through a common header (424) having check valves (425 and 425*a*) through a flow meter (20) and then into wellbores, wellsite hydrocarbon processing units pipelines and additive processing units at a selected flow rate as set forth in FIG. 1. In the embodiment set forth in this FIG. 4, the onsite controller (80), after control signals to the additive pump in service (e.g. 18*a* or 18*b*) fails to result in an acceptable flow rate of additive, turns off the additive pump in service and turns on the redundant pump (e.g. 18*b* or 18*a*, respectively). The onsite controller (80) then sends a signal via the data link (85) to the remote controller (82) which in turn sends a signal via the network to notify a remote attendant that pumps in the system need service. In yet another embodiment, a remote attendant or computer can send a signal (not shown) to the onsite controller (80) to rotate use between the additive pumps (18*a* and 18*b*) for maintenance purposes.

While the foregoing disclosure is directed to the preferred embodiments of the invention, various modifications will be apparent to those skilled in the art. It is intended that all variations within the scope of the appended claims be embraced by the foregoing disclosure.

What is claimed is:

1. A system for monitoring and controlling a supply of an additive introduced into formation fluid within a production wellbore, comprising:

(a) a flow control device for supplying a selected additive from a source thereof at a wellsite to the formation fluid being recovered from the production wellbore;

(b) a flow measuring device for providing a signal representative of the flow rate of the selected additive supplied to said formation fluid in the production wellbore;

(c) a first onsite controller receiving the signals from the flow measuring device and determining therefrom the flow rate, said first onsite controller transmitting signals representative of the flow rate to a remote location; and (d) a second remote controller at said remote location receiving signals transmitted by said first controller and in response thereto transmitting command signals to said first controller representative of a desired change in the flow rate of the selected additive;

wherein the first onsite controller causes the flow control device to change the flow rate of the selected additive in response to the command signals and the system supplies the selected additive such that it is present at a concentration of from about 1 ppm to about 10,000 ppm in the formation fluid recovered from the production wellbore, and the first onsite controller is programmed with a step based flow rate control model.

2. The system of claim 1, wherein said first onsite controller includes a display that displays at least the flow rate of the selected additive supplied to the formation fluid.

3. The system of claim 1, wherein the additive is supplied to a selected location in the wellbore and a hydrocarbon processing unit the formation fluid at the wellsite.

4. The system of claim 1 further comprising a solar power array used to power the system.

5. The system of claim 1 further comprising a program associated with said first onsite controller that enables the onsite controller to perform a plurality of on-board functions.

6. The system of claim 5, wherein said plurality of functions includes at least one of (i) determining the difference between the amount of additive introduced and a predetermined desired amount, (ii) calibration of the flow control device, and (iii) periodic polling of said flow measuring device.

7. The system of claim 1, wherein said first onsite controller is programmable (i) at the wellsite or, (ii) by said second remote controller.

8. The system of claim 1 further comprising a data base management system associated with said second remote controller.

9. The system of claim 8, wherein said second remote controller is adapted to communicate with a plurality of computers over a network.

10. The system of claim 1, wherein the flow control device is one of (i) an electric pump, or (ii) a pneumatic pump.

11. The system of claim 1 further including at least one sensor providing a measure of a characteristic of said formation fluid, said characteristic being the presence or formation of any of the group consisting of corrosion, sulfites, hydrogen sulfide, paraffin, emulsion, scale, asphaltenes, and hydrates.

12. The system of claim 11, wherein said system alters the supply of said selected additive in response to said measured characteristic.

13. The system of claim 6 wherein the system includes redundant flow control devices which are controlled by the onsite controller.

14. The system of claim 1 for monitoring and controlling the supply of additives to a plurality of production wells, said system further comprising:

(a) a supply line and a flow control device associated with each of said plurality of wells;

(b) a flow measuring device in each said supply line measuring a parameter indicative of the flow rate of an additive supplied to a corresponding well, each said flow measuring device generating signals indicative of a flow rate of the additive supplied to its corresponding well; and (c) a first onsite controller receives signals from each of the flow measuring devices and transmits signals representative of the flow rate for each well to a second remote controller which in response to the signals transmitted by said first onsite controller transmits to said first onsite controller command signals representative of a desired change in the flow rate of the additives supplied to each said well.

15. The system of claim 14, wherein the additive is injected into each said well at predetermined depths.

16. The system of claim 1 wherein the additive is driven using a high pressure source.

17. The system of claim 16 wherein the high pressure source is a compressed gas supply.

18. The system of claim 17 further comprising a high pressure control valve.

19. The system of claim 18 wherein the high pressure control valve is a two stage high pressure control valve.

20. A method of monitoring at a wellsite, the supply of additives to formation fluid recovered through a production wellbore and controlling said supply of additives into the production wellbore from a remote location, said method comprising:

(a) controlling the flow rate of the supply of a selected additive from a source thereof at the wellsite into said formation fluid via a supply line into the production wellbore using the system of claim 1;

(b) measuring a parameter indicative of the flow rate of the additive supplied to said formation fluid and generating a signal indicative of said flow rate;

(c) receiving at the wellsite the signal indicative of the flow rate and transmitting a signal representative of the flow rate to the remote location;

(d) receiving at said remote location signals transmitted from the wellsite and in response thereto transmitting command signals to the wellsite representative of a desired change in the flow rate of the additive supplied; and (e) controlling the flow rate of the supply of the additive in response to the command signals such that the additive is present at a concentration of from about 1 ppm to about 10,000 ppm in the formation fluid recovered from the wellbore.

21. The method of claim 20 further comprising displaying at the well site the flow rate of the additive supplied to the formation fluid.

22. The method of claim 21 further comprising a manual override for controlling the flow rate of the supply of the additive by performing a function selected from (i) setting a flow rate of the additive, (ii) setting a range of allowable values for the flow rate of the additive, and (iii) combinations thereof.

23. The method of claim 20 additionally comprising the step of using at least one sensor providing a measure of a characteristic of said formation fluid, said characteristic being the presence or formation of any of the group consisting of corrosion, sulfites, hydrogen sulfide, paraffin, emulsion, scale, asphaltenes, and hydrates.

24. The method of claim 23 further comprising altering the supply of said selected additive in response to said measured characteristic.

25. The method of claim 20 further comprising controlling the flow rate of a supply of a second additive in response to the command signals such that the second additive is present at a concentration of from about 1 ppm to about 10,000 ppm in the formation fluid recovered from the wellbore.

* * * * *